US011387089B2

(12) United States Patent
Hiramatsu

(10) Patent No.: US 11,387,089 B2
(45) Date of Patent: Jul. 12, 2022

(54) DIRECT SAMPLE INTRODUCTION DEVICE AND METHOD FOR COOLING SAMPLE INTRODUCTION PROBE

(71) Applicant: SHIMADZU CORPORATION, Kyoto (JP)

(72) Inventor: Yoshiro Hiramatsu, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 0 days.

(21) Appl. No.: 16/952,359

(22) Filed: Nov. 19, 2020

(65) Prior Publication Data

US 2021/0202228 A1 Jul. 1, 2021

(30) Foreign Application Priority Data

Dec. 25, 2019 (JP) ..... JP2019-234813

(51) Int. Cl.
*H01J 49/00* (2006.01)
*H01J 49/04* (2006.01)

(52) U.S. Cl.
CPC ..... *H01J 49/0468* (2013.01); *H01J 49/0422* (2013.01)

(58) Field of Classification Search
CPC ... H01J 49/0468; H01J 49/0422; H01J 49/049
USPC ..... 250/281, 282, 288, 423 R
See application file for complete search history.

(56) References Cited

U.S. PATENT DOCUMENTS

2009/0266981 A1* 10/2009 Shiokawa ..... H01J 49/0009 250/282
2009/0272894 A1* 11/2009 Shiokawa ..... H01J 49/145 250/282
2013/0320206 A1* 12/2013 Christy ..... G01N 33/2025 250/288
2014/0033835 A1* 2/2014 Hendrikse ..... G01N 1/44 73/863.12

FOREIGN PATENT DOCUMENTS

JP 2009-264950 A 11/2009

* cited by examiner

*Primary Examiner* — Michael Maskell
(74) *Attorney, Agent, or Firm* — Sughrue Mion, PLLC

(57) ABSTRACT

A direct sample introduction device includes: a pre-evacuating chamber that has an internal space extending in a first direction through which a sample introduction probe extends in the first direction; a first ventilation unit that is allowed to be opened and closed, with a first end thereof being connected to the pre-evacuating chamber; and a second ventilation unit a first end of which is connected to the pre-evacuating chamber and a second end of which is connected to a low pressure source.

13 Claims, 5 Drawing Sheets

DIRECT SAMPLE INTRODUCTION DEVICE AND METHOD FOR COOLING SAMPLE INTRODUCTION PROBE

INCORPORATION BY REFERENCE

The disclosure of the following priority application is herein incorporated by reference: Japanese Patent Application No. 2019-234813 filed Dec. 25, 2019

TECHNICAL FIELD

The present invention relates to a direct sample introduction device and a method for cooling a sample introduction probe

BACKGROUND ART

In a mass spectrometer, other than a method for introducing a sample to be analyzed which has passed through a preliminary analyzer such as a gas chromatograph, a direct sample introduction method (direct introduction probe method or direct exposure probe method) in which a sample to be analyzed is introduced directly into an ion source without passing through the preliminary analyzer is also utilized. In the direct sample introduction method, a probe with a solid or liquid sample to be analyzed inserted in or coated at the tip is introduced into the mass spectrometer, and the probe is heated to vaporize the sample to be analyzed (See Patent Literature 1).

CITATION LIST

Patent Literature

Patent Literature 1: Japanese Laid-Open Patent Publication No. 2009-264950

SUMMARY OF INVENTION

Technical Problem

In the direct sample introduction method, a probe is heated to around 500° C. in order to vaporize a sample. Therefore, in order to take out the probe used for introducing the sample from a direct sample introducing device or a mass spectrometer, it is necessary to wait for the temperature of the probe to drop to around room temperature for safety. Therefore, because of a waiting time required for cooling the probe during the analysis of a plurality of samples, it is difficult to sufficiently improve the analysis throughput.

Solution to Problem

According to the first aspect, a direct sample introduction device includes: a pre-evacuating chamber that has an internal space extending in a first direction through which a sample introduction probe extends in the first direction; a first ventilation unit that is allowed to be opened and closed, with a first end thereof being connected to the pre-evacuating chamber; and a second ventilation unit a first end of which is connected to the pre-evacuating chamber and a second end of which is connected to a low pressure source.

According to the second aspect, a method of cooling a sample introduction probe includes: arranging a sample introduction probe in the pre-evacuating chamber having an internal space extending in a first direction; supplying gas to an inside of the pre-evacuating chamber through a first ventilation unit a first end of which is connected to the pre-evacuating chamber; and evacuating gas of the inside of the pre-evacuating chamber through a second ventilation unit a first end of which is connected to the pre-evacuating chamber.

Advantageous Effects of Invention

According to the present invention, the heated sample introduction probe can be cooled in a short time, and the waiting time for taking out the sample introduction probe can be shortened.

DESCRIPTION OF EMBODIMENTS

One Embodiment of Direct Sample Introduction Device

Hereinafter, a direct sample introduction device 1 according to one embodiment will be described with reference to FIGS. 1 and 2.

Figure 1:
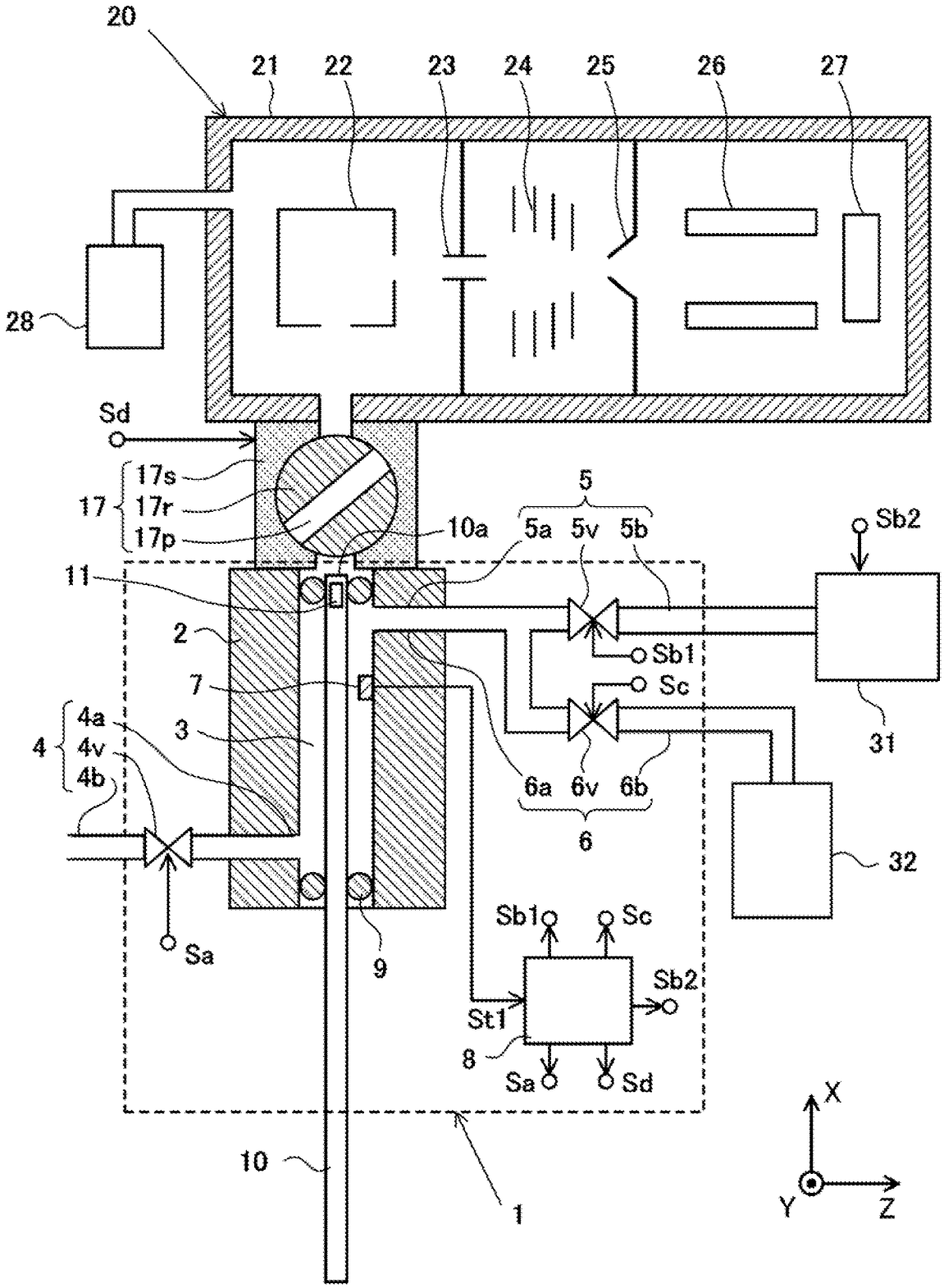
FIG. 1 is a cross-sectional view showing a state in which a sample introduction probe is being pre-evacuated or a sample introduction probe is being cooled in a mass spectrometer equipped with a direct sample introduction device according to one embodiment.

FIG. 1 is a cross-sectional view showing a mass spectrometer 20 equipped with the direct sample introduction device 1 which is shown in a region surrounded by a broken line according to one embodiment. FIG. 1 shows a state in which a sample introduction probe 10 is being pre-evacuated or the sample introduction probe 10 is being cooled in the direct sample introduction device 1.

Figure 2:
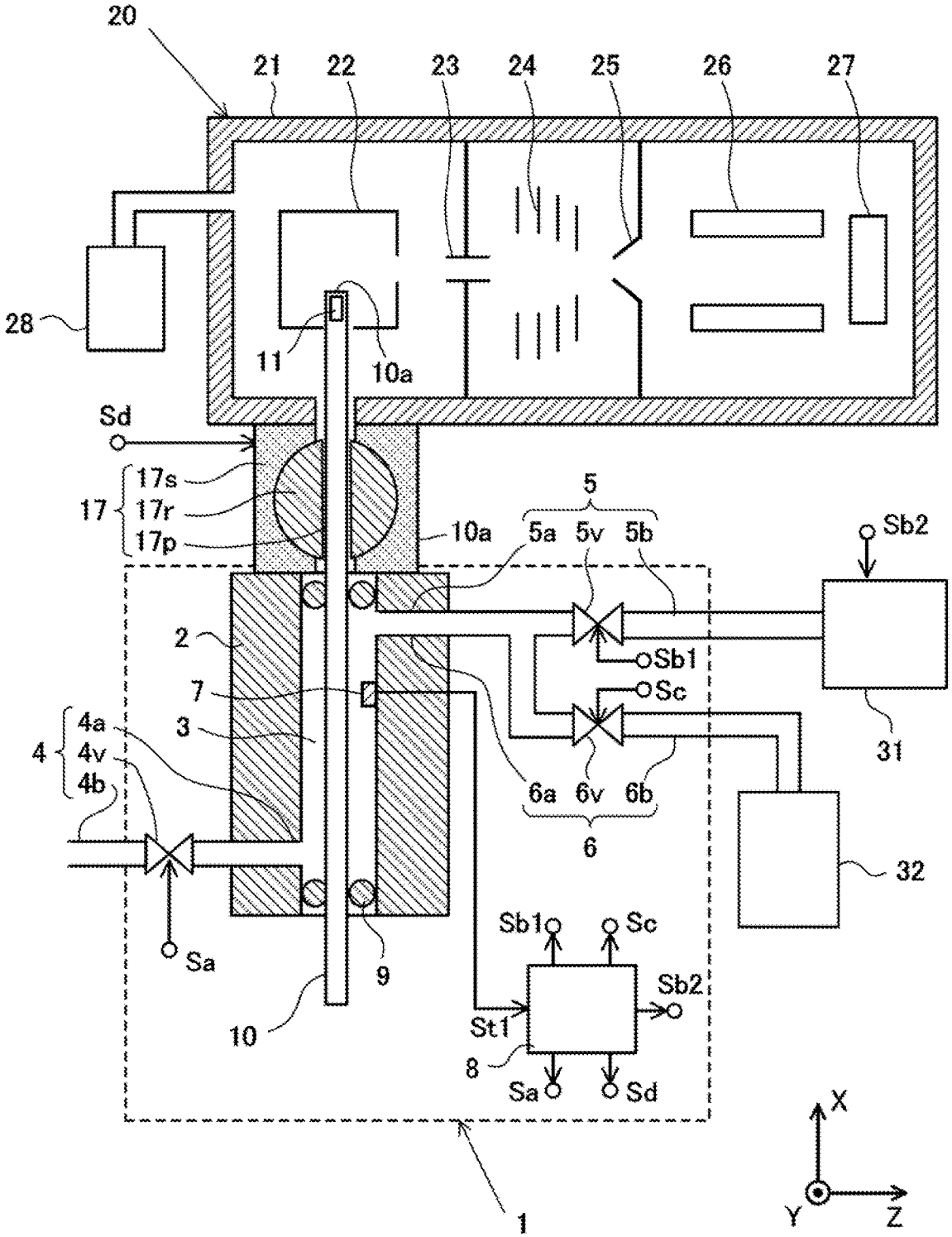
FIG. 2 is a cross-sectional view showing a state in which a sample is being introduced from a sample introduction probe into the mass spectrometer equipped with a direct sample introduction device according to one embodiment.

FIG. 2 is a cross-sectional view showing a state in which a sample is being introduced from the sample introduction probe 10 to the mass spectrometer 20 equipped with the direct sample introduction device 1 according to one embodiment which is shown in a region surrounded by a broken line.

The mass spectrometer 20 is, for example, a quadrupole mass spectrometer including an ionization chamber 22, a skimmer 23, an ion guide 24, a partition electrode 25, a quadrupole mass filter 26, and an ion detector 27 in a housing 21.

The sample to be analyzed is ionized in the ionization chamber 22, and then proceeds in the +Z direction, passes through the skimmer 23, is guided by the ion guide 24 to pass through the partition electrode 25, is selected by the quadrupole mass filter 26 according to m/z, and is incident to the ion detector 27.

The inside of the housing 21 is depressurized by a vacuum pump 28.

The direct sample introduction device 1 includes a pre-evacuating chamber 2 having an internal space 3 extending in the X direction shown by an arrow in FIGS. 1 and 2, and the internal space 3 of the pre-evacuating chamber 2 is configured such that the sample introduction probe 10 can run through the internal space in the X direction.

A gate valve 17 is provided between the pre-evacuating chamber 2 of the direct sample introduction device 1 and the housing 21 of the mass spectrometer 20. The gate valve 17 includes, as an example, an outer frame 17*s* and a rotary valve 17*r* having a through hole 17*p* therein. The rotary valve 17*r* is rotatable with respect to the outer frame 17*s* about a rotation axis in the Y direction which is orthogonal to the X direction and to the Z direction.

As shown in FIG. 1, depending on the rotation angle of the rotary valve 17*r*, when the direction of the through hole 17*p* does not coincide with the X direction, the gate valve 17 is in a closed state so that the inside of the housing 21 is sealed from the pre-evacuating chamber 2.

On the other hand, depending on the rotation angle of the rotary valve 17*r*, when the direction of the through hole 17*p* coincides with the X direction, the gate valve 17 shifts to an open state, and then the sample introduction probe 10 can be inserted into the housing 21 via the through hole 17*p* from the pre-evacuating chamber 2.

The gate valve 17 is not limited to the one having the rotary valve 17*r* described above, but may be one having a valve that is movable linearly.

A gas supply/evacuate unit 4, a gas evacuate unit 5, and a gas supply unit 6 are connected to the internal space 3 of the pre-evacuating chamber 2, and the gas in the pre-evacuating chamber 2 is supplied or evacuated through the gas supply/evacuate unit 4, the gas evacuate unit 5, or the gas supply unit 6.

The gas supply/evacuate unit 4 includes a valve 4*v*, and one end (first end) 4*a* extended from the valve 4*v* is connected to the pre-evacuating chamber 2 and the other end (second end) 4*b* extended from the valve 4*v* is open to the atmosphere (or other than the internal space 3 of the pre-evacuating chamber 2).

The gas evacuate unit 5 includes a valve 5*v*, and one end (first end) 5*a* extended from the valve 5*v* is connected to the pre-evacuating chamber 2 and the other end (second end) 5*b* extended from the valve 5*v* is connected to a low pressure source 31, such as a vacuum pump. The low-pressure source 31 is, for example, a vacuum pump, and may be a back pump of the vacuum pump 28 connected to the mass spectrometer 20.

As an example, the first end 5*a* of the gas evacuate unit 5 and the first end 4*a* of the gas supply/evacuate unit 4 are arranged at different positions in the pre-evacuating chamber 2 in the X direction.

The gas supply unit 6 includes a valve 6*v*, and one end (first end) 6*a* extended from the valve 6*v* is integrated with the first end 5*a* of the gas evacuate unit 54 and connected to the pre-evacuating chamber 2, and the other end (second end) 6*b* extended from valve 6*v* is connected to a gas supply source 32 that supplies a gas having pressure equal to or higher than atmospheric pressure. As an example, the first end 6*a* of the gas supply unit 6 and the first end 4*a* of the gas supply/evacuate unit 4 are arranged at different positions in the pre-evacuating chamber 2 in the X direction.

The gas supply source 32 may be, for example, a compressor or the like, and if the low pressure source 31 or the vacuum pump 28 connected to the mass spectrometer 20 is capable of supplying a predetermined pressure, the low pressure source 31 or the vacuum pump 28 may be used as the gas supply source 32. The gas supplied from the gas supply source 32 may be air or a gas other than air such as nitrogen.

For improving the airtightness of the internal space 3 of the pre-evacuating chamber 2 in a state where the sample introduction probe 10 is inserted, seal members 9 such as O-rings are provided near both ends in the X direction of the pre-evacuating chamber 2.

The pre-evacuating chamber 2 is provided with a contact type or non-contact type temperature sensor 7 for measuring information about the temperature of the sample introduction probe 10 which is to be inserted into the pre-evacuating chamber 2. The temperature information measured by the temperature sensor 7 is input to a control unit 8 as a signal St1.

The control unit 8, as an example, transmits control signals Sa, Sb1 and Sc respectively to the valves 4*v* of the gas supply/evacuate unit 4, the valve 5*v* of the gas evacuate unit 5, and the valve 6*v* of the gas supply unit 6 to control the opening/closing operation of each valve.

Further, the control unit 8 may send a control signal Sd to the gate valve 17 to control opening/closing operation of the gate valve 17.

In one embodiment of the direct sample introduction device 1, the gas supply/evacuate unit 4 may be referred to as a first ventilation unit, the gas evacuate unit 5 may be referred to as a second ventilation unit, and the gas supply unit 6 may be referred to as a third ventilation unit.

In one embodiment as described above, the first end 5*a* of the gas evacuate unit 5 and the first end 6*a* of the gas supply unit 6 are integrated together and connected to the pre-evacuating chamber 2. However, the first end 5*a* of the gas evacuate unit 5 and the first end 6*a* of the gas supply unit 6 may be individually connected to the pre-evacuating chamber 2.

As will be explained in an embodiment of the method for cooling the sample introduction probe 10, the direct sample introduction device 1 can cool the sample introduction probe 10 without necessarily including the evacuate unit 6. Therefore, the direct sample introduction device 1 does not necessarily have the evacuate unit 6.

The control unit 8 may control the pressure (low pressure) itself generated by the low pressure source 31 by transmitting a control signal Sb2 to the low pressure source 31 instead of controlling the opening/closing operation of the valve 5*v* of the gas evacuate unit 5. In this case, the valve 5*v* of the gas evacuate unit 5 may be always in an open state, or the valve 5*v* of the gas evacuate unit 5 may not be provided.

Method of Mass Spectrometry Using Direct Sample Introduction Device of One Embodiment Hereinafter, a method of mass spectrometry using the direct sample introduction device 1 and the mass spectrometer 20 will be described with reference to FIGS. 1 to 3.

Figure 3:
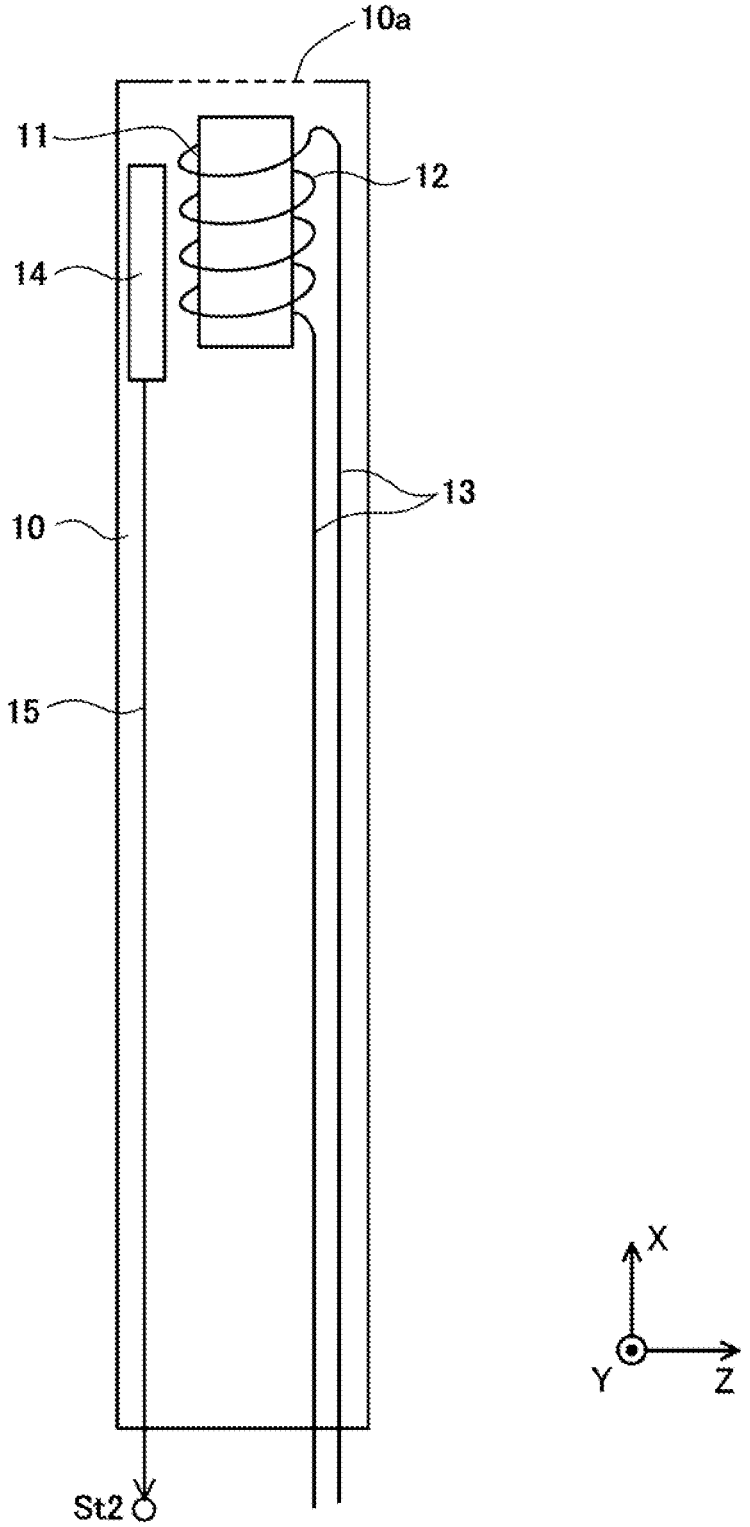
FIG. 3 is a diagram showing an example of a sample introduction probe.

FIG. 3 is a cross-sectional view showing an example of the sample introduction probe 10 used in the direct sample introduction device 1 of the embodiment. The sample introduction probe 10 is provided with a heater 12 for heating a sample cup 11 and a wiring 13 for supplying electric power for heating the heater 12. Further, a temperature sensor 14 may be provided for measuring information about the temperature in the vicinity of a tip portion 10*a* including the sample cup 11 of the sample introduction probe 10. The temperature sensor 14 outputs a signal St2 including information about temperature via a signal line 15.

For analysis, an operator puts a sample to be analyzed in the sample cup 11 arranged near the tip portion 10*a* of the sample introduction probe 10. Alternatively, the sample to be analyzed may be coated on the heater 12.

The operator inserts the sample introduction probe 10 which the sample is put in or coated on into the internal space 3 of the pre-evacuating chamber 2 of the sample introduction device 1 from the tip portion 10*a*. When the sample introduction probe 10 is inserted, the seal members 9 contact with the sample introduction probe 10, so that the internal space 3 is substantially airtight to the outside.

It is noted that, the internal space 3 of the pre-evacuating chamber 2 is open to the atmosphere until the sample introduction probe 10 is inserted. Therefore, until the sample introduction probe 10 is inserted, the control unit 8 transmits the control signal Sb1 to the valve 5*v* to make the valve 5*v* in a closed state so as to block the flow of gas via the gas evacuate unit 5 from the pre-evacuating chamber 2 to the low pressure source 31. Further, the control unit 8 transmits the control signal Sc to the valve 6*v* to make the valve 6*v* in a closed state so as to block the flow of gas via the gas supply unit 6 from the gas supply source 32 to the pre-evacuating chamber 2. Further, the control unit 8 makes the gate valve 17 also in a closed state.

When the sample introduction probe 10 is inserted into the internal space 3 of the pre-evacuating chamber 2, the control unit 8 transmits the control signal Sb1 to the valve 5*v* to make the valve 5*v* in an open state. And the control unit 8 transmits the control signal Sa to the valve 4*v* to make the valve 4*v* in a closed state so as to block the flow of gas via the gas supply/evacuate unit 4 from the outside to the pre-evacuating chamber 2. As a result, the gas in the internal space 3 of the pre-evacuating chamber 2 is evacuated via the gas evacuate unit 5, and the internal space 3 is depressurized.

After the internal space 3 of the pre-evacuating chamber 2 is sufficiently depressurized, the operator makes the gate valve 17 in an open state and inserts the tip portion 10*a* of the sample introduction probe 10 into the ionization chamber 22 in the mass spectrometer 20 through the gate valve 17. Then, electric power is supplied through the wiring 13 in the sample introduction probe 10 to heat the heater 12 (see FIG. 3), so that the sample put in the sample cup 11 or coated on the heater 12 is vaporized and released from the tip portion 10*a*. As described above, FIG. 2 shows this state.

The sample introduced into the ionization chamber 22 is ionized in the ionization chamber 22 and, as described above, mass-analyzed by the mass spectrometer 20.

After completion of the sample analysis, the sample introduction probe 10 is taken out from the mass spectrometer 20 and the direct sample introduction device 1. However, since the sample introduction probe 10 is being heated to, for example, around 500° C. for vaporizing the sample, it is necessary to cool the sample introduction probe 10 to around room temperature before taking it out in order to ensure safety.

First Embodiment of Method for Cooling Sample Introduction Probe

Hereinafter, with reference to FIG. 4, a first embodiment of a method for taking out the sample introduction probe 10 and cooling the sample introduction probe 10 will be described. Note that the following description also describes a part of effects of the direct sample introduction device 1 of the above-described one embodiment.

Figure 4:
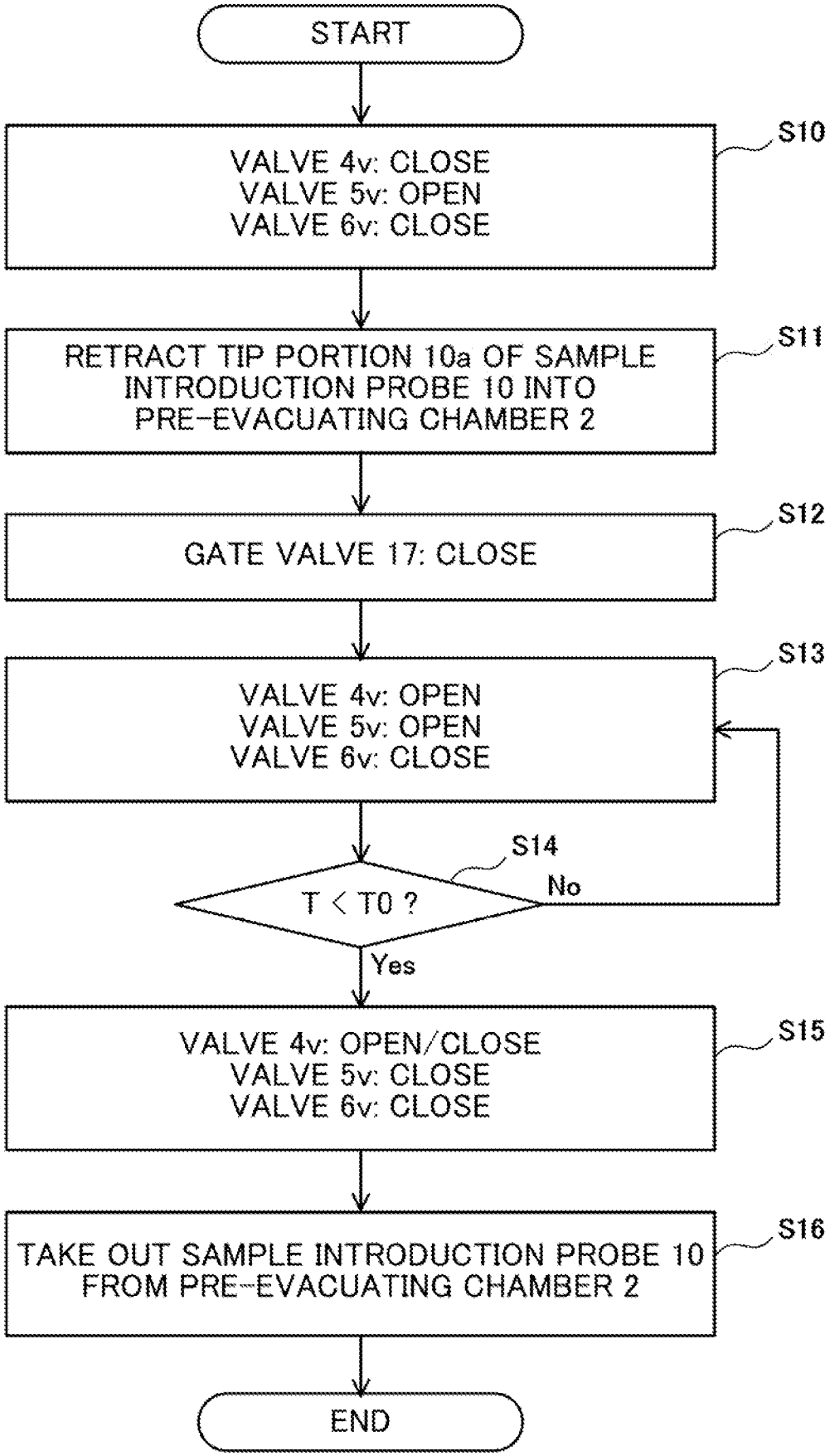
FIG. 4 is a diagram showing a first embodiment of a method for cooling a sample introduction probe.

FIG. 4 is a diagram showing a sequence of a method for cooling the sample introduction probe 10 in the first embodiment.

In step S10 in the initial state, the tip portion 10*a* of the sample introduction probe 10 is inserted in the mass spectrometer 20. At this stage, as described above, the valve 4*v* is in the closed state (Close), the valve 5*v* is in the open state (Open), and the valve 6*v* is in the closed state (Close).

In the subsequent step S11, the sample introduction probe 10 is retracted until the tip portion 10*a* enters the pre-evacuating chamber 2.

Then, in step S12, the gate valve 17 is moved to be in the closed state (Close).

In the following step S13, the control unit 8 transmits the control signal Sa to the valve 4*v* to make the valve 4*v* in the open state (Open). By shifting the valve 4*v* to the open state (Open), the external gas (air) flows into the inside of the pre-evacuating chamber 2 from the second end 4*b* of the gas supply/evacuate unit 4 through the valve 4*v* and the first end 4*a* of the gas supply/evacuate unit 4.

In step S13, the valve 5*v* is still in the open state (Open), and the evacuation of the pre-evacuating chamber 2 by the low pressure source 31 through the gas evacuate unit 5 is continuously performed. Therefore, the gas that has flowed into the pre-evacuating chamber 2 through the first end 4*a* of the gas supply/evacuate unit 4 passes around the side surface of the sample introduction probe 10 and flows along the X direction in the pre-evacuating chamber 2 towards the first end 5*a* of the gas evacuate unit 5. Due to this gas flow, the sample introduction probe 10 can be cooled in a short time.

In the cooling method of the sample introduction probe 10 according to the first embodiment, the gas supply/evacuate unit 4 can be referred to as the first ventilation unit and the gas evacuate unit 5 can be referred to as the second ventilation unit.

In step S14, the control unit 8 determines as to whether or not the temperature T indicated in the temperature sensor 7 is lower than a predetermined temperature T0 based on the signal St1 indicative of the information about the temperature measured by the temperature sensor 7 installed in the pre-evacuating chamber 2. The predetermined temperature T0 is, for example, temperature at which there is no risk of burns even if the sample introduction probe 10 is touched, and is, for example, around 50° C. to 70° C.

If the determination in step S14 is Yes, the process proceeds to step S15, and if it is No, the process returns to step S13.

In step S15, the control unit 8 stops the cooling of the sample introduction probe 10. That is, the control unit 8 transmits the control signal Sb1 to the valve 5*v* to shift it to the closed state (Close). The valve 6*v* is maintained in the closed state (Close).

The valve 4*v* may be either in the open state (Open) or in the closed state (Close).

In step S15, both the valve 5*v* and the valve 6*v* are in the closed state (Close) so as to avoid unnecessary evacuation from the gas evacuate unit 5 and unnecessary gas supply from the gas supply unit 6 to reduce an operating cost of the direct sample introduction device 1. Therefore, if only the cooling of the sample introduction probe 10 is concerned, the valve 5*v* or the valve 6*v* may be set to be in the open state (Open) in step S15.

In subsequent step S16, the operator takes out the sample introduction probe 10 from the pre-evacuating chamber 2. Since the sample introduction probe 10 has been sufficiently cooled through steps 13 to 15, there is no risk of suffering burns even if the operator touches the sample introduction probe 10.

In the above example, the valve 4*v*, the valve 5*v*, and the valve 6*v* are automatic opening/closing valves, and opening/closing operations of the valves are controlled by the control signals Sa to Sc transmitted from the control unit 8, respectively. However, at least one of the valve 4*v*, the valve 5*v*, and the valve 6*v* may be a manual operation valve, and in this case, the opening/closing operations of the manual operation valve in the above steps are performed by the operator.

Alternatively, the gate valve 17 may also be an automatic opening/closing valve, and in this case, the opening/closing operation is controlled by the control signal Sd transmitted from the control unit 8.

Further, the insertion and removal of the sample introduction probe 10 into and from the pre-evacuating chamber 2 may be performed by an automatic carrying/unloading device controlled by the control unit 8.

Second Embodiment of Method for Cooling Sample Introduction Probe

Figure 5:
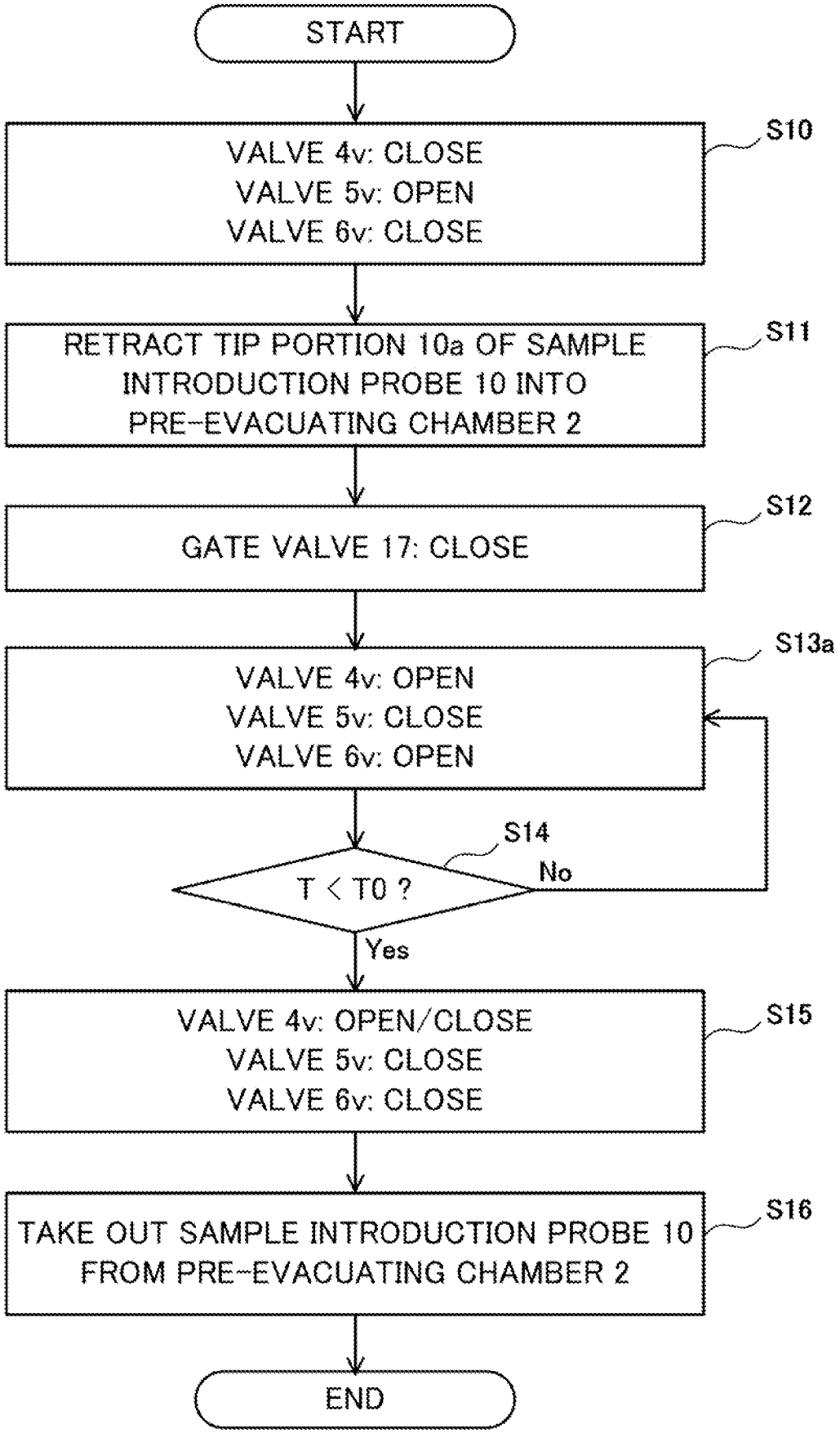
FIG. 5 is a diagram showing a second embodiment of a method for cooling a sample introduction probe.

Hereinafter, a cooling method of the sample introduction probe 10 of a second embodiment will be described with reference to FIG. 5. The following cooling method of the second embodiment is basically the same as the cooling method of the above-described first embodiment, and therefore the differences will be described below, and the description of common parts will be omitted as appropriate.

With respect to the cooling method of the sample introduction probe 10 of the second embodiment, it is different from the first embodiment in that step 13 of the above-described first embodiment is replaced with step 13*a* described below. Other steps of the second embodiment are common to the above-described first embodiment.

In step 13*a* of the second embodiment, the control unit 8 transmits the control signal Sa to the valve 4*v* to shift it to the open state (Open), transmits the control signal Sb1 to the valve 5*v* to shift it to the closed state (Close), and transmits the control signal Sc to the valve 6*v* to shift it to the open state (Open).

By setting the valve 6*v* in the open state (open), the gas having pressure higher than the atmospheric pressure supplied from the gas supply source 32 flows into the inside of the pre-evacuating chamber 2 via the second end 6*b*, the valve 6*v* and the first end 6*a* of the gas supply unit 6. As a result, the pressure inside the pre-evacuating chamber 2 becomes higher than the atmospheric pressure, so that part of the gas inside the pre-evacuating chamber 2 flows out to the outside (atmosphere) of the pre-evacuating chamber 2 through the gas supply/evacuate unit 4.

Therefore, the gas having flowed into the inside of the pre-evacuating chamber 2 through the first end 6*a* of the gas supply unit 6 passes around the side surface of the sample introduction probe 10 and flows along the X direction in the pre-evacuating chamber 2 toward the first end 4*a* of the gas supply/evacuate unit 4. In the cooling method according to the second embodiment, the sample introduction probe 10 can be cooled in a short time by this gas flow.

In the cooling method of the sample introduction probe 10 according to the second embodiment, the gas supply unit 6 can be referred to as the first ventilation unit and the gas supply/evacuate unit 4 can be referred to as the second ventilation unit.

In the cooling method according to the above-described first embodiment and the cooling method according to the above-described second embodiment, in step 14, the control unit 8 makes determination based on the signal St1 indicative of the information about the temperature measured by the temperature sensor 7 installed in the pre-evacuating chamber 2.

However, the signal St2 indicative of the information about the temperature measured by the temperature sensor 14 provided in the sample introduction probe 10 described above may be input to the control unit 8 and the control unit 8 may perform the above determination based on the signal St2.

Alternatively, the control unit 8 may determine, in Step 14, whether or not to proceed to Step 15 based on the cooling duration time in Step 13 in place of the temperature information.

Alternatively, in step 14, the control unit 8 may determine whether or not to proceed to step 15 based on an instruction input by the operator.

In the above description of the method of mass spectrometry and the method for cooling the sample introduction probe 10, the gas evacuate unit 5 is equipped with the valve 5*v*, and the control unit 8 controls the opening/closing operation of the valve 5*v* by the signal Sb1. However, as described above, the direct sample introduction device 1 may have an alternative construction in which the gas evacuate unit 5 does not have the valve 5*v* or the valve 5*v* is always in the open state, and the control unit 8 controls the pressure (low pressure) of the low pressure source 31 by the control signal Sb2.

In this case, in the above-described mass spectrometry method and the method for cooling the sample introduction probe 10, instead of switching the open/closed state of the valve 5*v* by the control signal Sb1, the control unit 8 transmits the control signal Sb2 to the low pressure source (or depressurization unit) 31 to control the pressure inside the low pressure source 31 to atmospheric pressure or to a low pressure state. Alternatively, the operator may operate the low pressure source 31 to control the pressure inside the low pressure source 31.

Although various embodiments and modifications have been described above, the present invention is not limited to those contents. Moreover, each of the embodiments may be applied individually or in combination. Other aspects that are conceivable within the scope of the technical concept of the present invention are also included within the scope of the present invention.

Aspects

It will be understood by those skilled in the art that the above-described plurality of exemplary embodiments or variations thereof are specific examples of the following aspects.

Item 1

A direct sample introduction device according to one aspect includes: a pre-evacuating chamber that has an internal space extending in a first direction through which a sample introduction probe extends in the first direction; a first ventilation unit that is allowed to be opened and closed, with a first end thereof being connected to the pre-evacuating chamber; and a second ventilation unit a first end of which is connected to the pre-evacuating chamber and a second end of which is connected to a low pressure source. As a result, a gas flow from the first ventilation unit to the second ventilation unit is formed in the pre-evacuating chamber 2 so that the sample introduction probe can be efficiently cooled by this gas flow. Thereby, it is possible to realize a direct sample introduction device that reduces a cooling time of the sample introduction probe.

Item 2

According to another aspect of the direct sample introduction device, in the direct sample introduction device according to Item 1, the first end of the first ventilation unit and the first end of the second ventilation unit are arranged at different positions to each other in the pre-evacuating chamber in the first direction. As a result, the gas flow formed in the pre-evacuating chamber can move along the side surface of the sample introduction probe, increasing the contact area between the gas flow and the sample introduction probe. It is thereby possible to cool the sample introduction probe more efficiently.

Item 3

The direct sample introduction device according to another aspect, in the direct sample introduction device according to Item 1 or Item 2, further includes a temperature sensor that measures information related to temperature of the sample introduction probe in the pre-evacuating chamber. As a result, it is possible to measure whether or not the sample introduction probe in the pre-evacuating chamber 2 has been cooled.

Item 4

The direct sample introduction device according to another aspect, in the direct sample introduction device according to any one of Items 1 to 3, further includes a control unit that controls an open/closed state of the first ventilation unit or at least one of an open/closed state of the second ventilation unit and pressure of the low pressure source. As a result, the control unit can automatically perform opening/closing operation of the valves necessary for cooling the sample introduction probe or control of the pressure in the low pressure source.

Item 5

The direct sample introduction device according to another aspect, in the direct sample introduction device according to any one of Items 1 to 3, further includes a third ventilation unit that is allowed to be opened and closed, with a first end thereof being connected to the pre-evacuating chamber and a second end thereof being connected to a gas supply source, wherein: the first end of the first ventilation unit and the first end of the third ventilation unit are arranged at different positions to each other in the pre-evacuating chamber in the first direction. As a result, flow of gas flowing from the third ventilation unit to the first ventilation unit can be formed in the pre-evacuating chamber, and the sample introduction probe can be cooled by this flow of gas.

Item 6

The direct sample introduction device according to another aspect, in the direct sample introduction device according to Item 5, further includes a control unit that controls an open/closed state of at least one of the first ventilation unit, the second ventilation unit and the third ventilation unit or pressure of the low pressure source. As a result, the control unit can automatically perform the opening/closing operation of the valves necessary for cooling the sample introduction probe and control of the pressure inside the low pressure source.

Item 7

According to another aspect of the direct sample introduction device, in the direct sample introduction device according to Item 4 or Item 6, the control unit controls the open/closed state or the pressure of the low pressure source based on information related to temperature of the sample introduction probe in the pre-evacuating chamber. As a result, the sample introduction probe can be cooled in the minimum necessary time, and the cooling time of the sample introduction probe can be further shortened.

Item 8

A method for cooling a sample introduction probe according to one aspect includes: arranging a sample introduction probe in a pre-evacuating chamber having an internal space extending in a first direction; supplying gas to the inside of the pre-evacuating chamber through a first ventilation unit a first end of which is connected to the pre-evacuating chamber; and evacuating gas of the inside of the pre-evacuating chamber through a second ventilation unit a first end of which is connected to the pre-evacuating chamber. As a result, the sample introduction probe can be efficiently cooled by the gas flow from the first ventilation unit to the second ventilation unit formed in the pre-evacuating chamber, and the cooling time of the sample introduction probe can be shortened.

Item 9

According to another aspect of the method for cooling a sample introduction probe, in the method for cooling a sample introduction probe according to Item 8, the first end of the first ventilation unit and the first end of the second ventilation unit are arranged at different positions to each other in the first direction; and the sample introduction probe is cooled by flowing gas from the first ventilation unit toward the second ventilation unit along the first direction in the pre-evacuating chamber. As a result, gas flow formed in the pre-evacuating chamber can flow along the side surface of the sample introduction probe, increasing the contact area between the gas flow and the sample introduction probe, and thereby it is possible to cool the sample introduction probe more efficiently.

Item 10

According to another aspect of the method for cooling a sample introduction probe, in the method for cooling a sample introduction probe according to Item 9, by depressurizing the second ventilation unit by connecting the second end of the second ventilation unit to a low pressure source, gas is caused to flow from the first ventilation unit toward the second ventilation unit. As a result, the gas flow formed in the pre-evacuating chamber can be strengthened by the low pressure supplied from the low pressure source so that the sample introduction probe can be cooled more efficiently.

Item 11

According to another aspect of the method for cooling a sample introduction probe, in the method for cooling a sample introduction probe according to Item 9, by pressurizing the first ventilation unit by connecting the second end of the first ventilation unit to a gas supply source, gas is caused to flow from the first ventilation unit toward the second ventilation unit. As a result, the high pressure gas supplied from the gas supply source can strengthen the gas flow formed in the pre-evacuating chamber so that the sample introduction probe can be cooled more efficiently.

Item 12

According to the method for cooling a sample introduction probe, in the method for cooling a sample introduction probe according to any one of Items 9 to 11, gas supply from the first ventilation unit to the inside of the pre-evacuating chamber and gas evacuation from the pre-evacuating chamber through the second ventilation unit are controlled based on information related to temperature of the sample introduction probe. As a result, the sample introduction probe can be cooled in the minimum necessary time, and the cooling time of the sample introduction probe can be further shortened.

REFERENCE SIGNS LIST

1 . . . Direct Sample Introduction Device
2 . . . Pre-evacuating Chamber
3 . . . Internal Space
4 . . . Gas Supply/evacuate Unit
5 . . . Gas Evacuate Unit
6 . . . Gas Supply Unit
4*v*, 5*v*, 6*v* . . . Valve
7 . . . Temperature Sensor
8 . . . Control Unit
9 . . . Seal Member
10 . . . Sample Introduction Probe
11 . . . Sample Cup
12 . . . Heater
14 . . . Temperature Sensor
17 . . . Gate Valve
20 . . . Mass Spectrometer
21 . . . Housing
22 . . . Ionization Chamber
28 . . . Vacuum Pump
31 . . . Low Pressure Source
32 . . . Gas Supply Source

The invention claimed is:

1. A direct sample introduction device, comprising:
a pre-evacuating chamber that has an internal space extending in a first direction through which a sample introduction probe extends in the first direction;
a first ventilation unit that is allowed to be opened and closed, with a first end thereof being connected to the pre-evacuating chamber; and
a second ventilation unit a first end of which is connected to the pre-evacuating chamber and a second end of which is connected to a low pressure source,
wherein the pre-evacuating chamber is connected to an ionization chamber configured to receive an end of the sample introduction probe in the first direction through an openable and closable gate valve,
the direct sample introduction device further comprising:
a control unit configured to control the first ventilation unit, the second ventilation unit and the gate valve,
wherein the control unit makes the first and second ventilation unit in an open state and the gate valve in a close state to send gas from the first ventilation unit to the low pressure source through the pre-evacuation chamber and the second ventilation unit.

2. The direct sample introduction device according to claim 1, wherein:
the first end of the first ventilation unit and the first end of the second ventilation unit are arranged at the pre-evacuating chamber at different positions to each other in the first direction.

3. The direct sample introduction device according to claim 1, further comprising:
a temperature sensor that measures information related to temperature of the sample introduction probe in the pre-evacuating chamber.

4. The direct sample introduction device according to claim 1, further comprising:
a control unit that controls an open/closed state of the first ventilation unit, or at least one of an open/closed state of the second ventilation unit and pressure of the low pressure source.

5. The direct sample introduction device according to claim 1, further comprising:
a third ventilation unit that is allowed to be opened and closed, with a first end thereof being connected to the pre-evacuating chamber and a second end thereof being connected to a gas supply source, wherein:
the first end of the first ventilation unit and the first end of the third ventilation unit are arranged at the pre-evacuating chamber at different positions to each other in the first direction.

6. The direct sample introduction device according to claim 5, further comprising:
a control unit that controls an open/closed state of at least one of the first ventilation unit, the second ventilation unit and the third ventilation unit, or pressure of the low pressure source.

7. The direct sample introduction device according to claim 4, wherein:
the control unit controls the open/closed state or the pressure of the low pressure source based on information related to temperature of the sample introduction probe in the pre-evacuating chamber.

8. The direct sample introduction device according to claim 6, wherein:
the control unit controls the open/closed state or the pressure of the low pressure source based on information related to temperature of the sample introduction probe in the pre-evacuating chamber.

9. A method for cooling a sample introduction probe, comprising:
providing a pre-evacuation chamber connected to an ionization chamber configured to receive an end of a sample introduction probe in a first direction through an openable and closable gate valve;
arranging the sample introduction probe in the pre-evacuating chamber having an internal space extending in the first direction;
supplying gas to an inside of the pre-evacuating chamber through a first ventilation unit a first end of which is connected to the pre-evacuating chamber;
evacuating gas of the inside of the pre-evacuating chamber through a second ventilation unit a first end of which is connected to the pre-evacuating chamber, and
controlling the first ventilation unit, the second ventilation unit and the gate valve by controlling the first and second ventilation unit in an open state and the gate valve in a close state to send gas from the first ventilation unit to the low pressure source through the pre-evacuation chamber and the second ventilation unit.

10. The method for cooling a sample introduction probe according to claim 9, wherein:
the first end of the first ventilation unit and the first end of the second ventilation unit are arranged at different positions to each other in the first direction; and
the sample introduction probe is cooled by flowing gas from the first ventilation unit towards the second ventilation unit along the first direction in the pre-evacuating chamber.

11. The method for cooling a sample introduction probe according to claim 10, wherein:
by depressurizing the second ventilation unit by connecting a second end of the second ventilation unit to a low pressure source, gas is caused to flow from the first ventilation unit towards the second ventilation unit.

12. The method for cooling a sample introduction probe according to claim 10, wherein:
by pressurizing the first ventilation unit by connecting a second end of the first ventilation unit to a gas supply source, gas is caused to flow from the first ventilation unit towards the second ventilation unit.

13. The method for cooling a sample introduction probe according to claim 9, wherein:

gas supply from the first ventilation unit to the inside of the pre-evacuating chamber and gas evacuation from the pre-evacuating chamber through the second ventilation unit are controlled based on information related to temperature of the sample introduction probe.

* * * * *